US006381927B1

(12) United States Patent
Moncrief et al.

(10) Patent No.: US 6,381,927 B1
(45) Date of Patent: May 7, 2002

(54) METHOD AND APPARATUS FOR FOLDING CARTON FLAPS IN A PACKAGING MACHINE

(75) Inventors: Frank Moncrief, Acworth; Jeff Disrud, Marietta; Timothy Wayne Hendricks, Acworth, all of GA (US)

(73) Assignee: Riverwood International Corporation, Atlanta, GA (US)

( * ) Notice: Subject to any disclaimer, the term of this patent is extended or adjusted under 35 U.S.C. 154(b) by 0 days.

(21) Appl. No.: 09/426,032

(22) Filed: Oct. 25, 1999

(51) Int. Cl.[7] ..... B65B 43/12

(52) U.S. Cl. ..... 53/457; 53/458; 53/381.1; 53/376.3; 53/387.2; 493/55; 493/123

(58) Field of Search ..... 53/458, 457, 381.1, 53/387.1, 387.2, 381.7, 376.3, 382.2, 382.3; 493/55, 123, 70, 71

(56) References Cited

U.S. PATENT DOCUMENTS 3,416,285 A * 12/1968 Standley et al.
3,690,223 A * 9/1972 Klausmann et al.
4,747,813 A * 5/1988 Genoud et al.
5,078,669 A * 1/1992 Dietrich et al.
5,096,360 A * 3/1992 Nelson
5,152,734 A * 10/1992 McAdam, III et al.
5,385,526 A * 1/1995 Sigrist et al.
5,715,657 A * 2/1998 Mondani et al.
5,782,734 A * 7/1998 Reuteler
5,826,408 A * 10/1998 Ford

* cited by examiner

*Primary Examiner*—Eugene Kim
(74) *Attorney, Agent, or Firm*—Womble Carlyle Sandridge & Rice, PLLC

(57) ABSTRACT

A flap folding assembly for engaging a work piece, such as a paperboard carton flap, and moving that flap into a desired position. The flap folding apparatus can be used in a continuous motion packaging machine to engage a sleeve type carton flap as the carton is transported downstream through the package machine. The apparatus is operated in timed relationship with the machine's carton conveyor either by mechanically interlinking the apparatus to the main machine drive, or by the use of a servo drive operated from and controlled by the packaging machine's main controller. The flap folding apparatus includes a vacuum cup driven in a circular path by a drive mechanism comprised of two spaced gears which are driven in the same direction of rotation.

10 Claims, 9 Drawing Sheets

METHOD AND APPARATUS FOR FOLDING CARTON FLAPS IN A PACKAGING MACHINE

FIELD OF THE INVENTION

This invention relates to continuous motion article packaging machines, such as used in the bottling industry to package pre-formed bottle groups into paperboard cartons or carriers. More particularly, this invention relates to a carton flap folding method and apparatus suited for use in a continuous motion packaging machine. The method and apparatus of the present invention, however, have applications in other environments requiring the manipulation of a workpiece into a desired orientation.

BACKGROUND OF THE INVENTION

Continuous motion article packaging machines, such as those used in the beverage packaging industry, are well known in the art. These machines typically include numerous workstations arranged sequentially along a conveying system, such as chain or belt conveyors. Such packaging machines include carton feeders for delivering collapsed paperboard cartons or carton blanks to a carton conveyor, article grouping mechanisms which arrange articles, such as beverage containers or bottles, into desired configurations, and packaging assemblies which place the articles into the carton and secure or close the carton. These operations occur continuously and at relatively high speeds, typically packaging the article groups at a rate of 150 packs per minute to 400 packs per minute, and higher.

During various stages of this process, the cartons or carton blanks are handled in a variety of ways. The cartons usually are supplied to the packaging machine by the carton feeder, which selects cartons one at a time from a carton supply magazine, and places the cartons onto the carton conveyor. Numerous different types of cartons are utilized in these operations, including wrap-type carton blanks, basket-type cartons having an open bottom wall, basket-type cartons having a closed bottom wall and sleeve-type cartons, including those with tapered side portions. These cartons require various different handling procedures, including placing the carton in a specific orientation as it proceeds downstream, folding pre-formed carton flaps and bringing opposed or adjacent carton portions into contact with one another to lock carton side walls or bottom walls together to complete the packaging operation.

The large variety of cartons have various characteristics which must be taken into account during the packaging operation. These characteristics include, for example, different sized flaps, score lines, handles, locking tabs, cut-out portions and webbing or gussets. When packaging articles in sleeve-type cartons, the sleeve typically is fed downstream in a collapsed or flattened state, and thereafter must be erected so that the opposed sidewalls are spaced from one another to form an interior, open area into which the articles are inserted. In erecting the carton using mechanical cams or vacuum assisted devices, the lower sidewall of the carton sleeve can be engaged and held against the conveyor or score rails, while the opposed, upper sidewall is raised. One common way of holding the lower sidewall during this step is to engage the carton's lower, major flaps with a fixed guide while the carton moves downstream, so that the carton is not lifted from the conveyor during the step of erecting the carton. In order to engage the carton's lower, major flaps, the flaps are directed below opposed guides or guide plates positioned on each side of the conveyer and extending a distance, for example approximately three feet, along the carton conveyor. The lower, major flap is caused to move downwardly in order to slide below the flap guides, while the carton is being moved in the downstream direction by the carton conveyor.

In the past, this flap folding step has been accomplished by using mechanical devices such as a cam or a pneumatic flap knocker, which contact the flaps, and with a camming surface, causes the flaps to move into a lowered position so that the flaps slide below the guides as the conveyor moves the carton downstream. The guide holds the flaps and the carton's lower sidewall which is attached to the flaps, in a fixed vertical position as the carton is continuously moved downstream. These prior devices, however, often require that the lower, major flap be independently accessible, that is not covered entirely by the upper, major flap, as it moved through the packaging machine, either by the design of the flaps, in which the lower, major flap extends beyond the upper, major flap, or with the use of a cut-out portion in the upper, major flap, to allow the mechanical element to contact the lower flap, only, and move the lower flap beneath the guide. Such carton designs, however, can adversely affect the carton's manufacture, or the appearance or function of the fully formed package. Therefore, it is desirable in many cases to avoid the use of cutouts, gussets, or different sized major flaps. This presents the problem, however, of effecting the folding of the lower, major flap beneath the guide while the upper flap is moved above the guide. Therefore, a need exists for a method and apparatus for folding the lower, major flaps of certain designs of sleeve-type cartons, including those having restricted access to the lower, major flaps, so that the lower flaps pass below a guide as the carton moves continuously downstream on the carton conveyor.

SUMMARY OF THE INVENTION

While the present invention is suited for use in continuous motion packaging machines as a flap folding assembly and method, it is adaptable to other applications in which a workpiece is contacted using a vacuum cup, and moved into another position. As a flap folding assembly and method, the present invention includes an apparatus positioned along the carton conveyor, and actuated in timed relationship with the downstream movement of the cartons to contact a carton flap and to move the carton flap into a desired position. One embodiment of the present invention comprises a flap folder positioned beneath the carton conveyor. The flap folder includes an upstanding arm which supports a vacuum cup that faces upwardly, toward the carton conveyor and the carton blank supported by the conveyor. The arm is moved so that the cup passes in a circular path toward and away from the conveyor and the transported cartons. The vertical arm is fixed to a horizontal crank link assembly. The arm and crank link assemblies are supported by shafts extending from spaced gears which are driven in timed relationship with the carton conveyor. The gears can be driven by a power takeoff from the main machine drive, or can be driven by a servo motor which receives a drive signal from the machine control computer.

Typically, two flap folder assemblies spaced on each side of the conveyor are utilized together in order to contact opposite ends of a carton carried transversely by the carton conveyor. The individual flap folder assemblies of a pair of assemblies are operated in unison, with one or more drive mechanisms turning the respective gears of each assembly so that the vacuum cups are positioned to contact opposite ends of the carton simultaneously. The pair of flap folding assemblies also can be driven from a single telescoping spline shaft, to permit simultaneous driving of the gears of the respective assemblies, and to allow the adjustment of the spacing between the opposed assemblies. This permits the flap folder assemblies to be used on packaging machines which are laterally adjustable to process different sizes or configurations of article groups.

DETAILED DESCRIPTION OF THE PREFERRED EMBODIMENT

Figure 1:
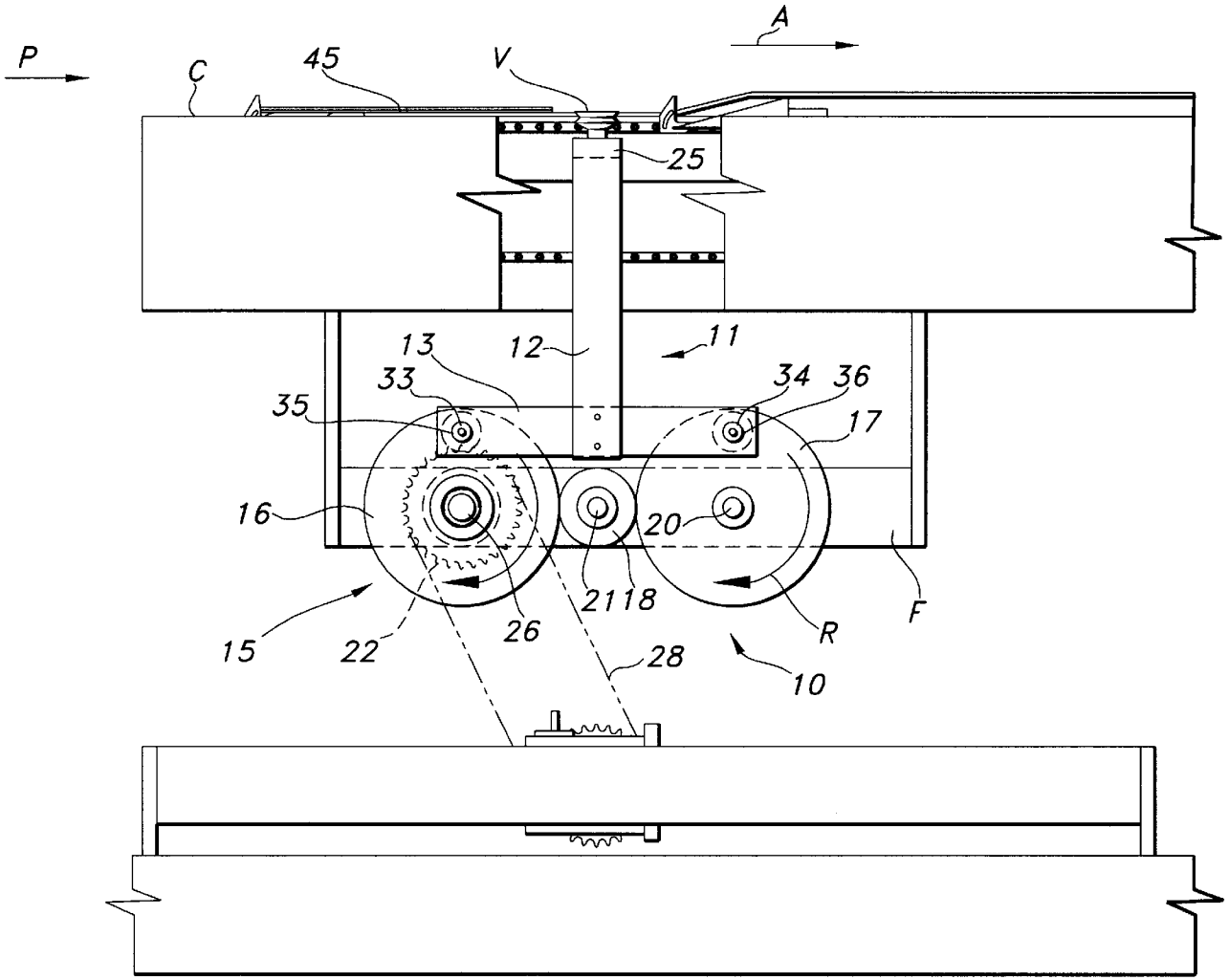
FIG. 1 is a side elevational view of the flap folding assembly of the present invention within a packaging machine.

Referring now to the drawing figures in which like reference numerals represent like elements throughout the several views, FIG. 1 shows a portion of a packaging machine P with a carton conveyor C for moving collapsed paperboard cartons 45 in the downstream direction indicated by arrow A. The flap folding assembly of the present invention is well suited for use in a continuous motion packaging machine, as discussed above, although the invention can be used in any environment requiring a part to be manipulated, such as folding a carton flap. For illustrative purposes, however, the flap folding assembly is positioned along the carton conveyor within a continuous motion packaging machine between a carton feeder and the work area where the sleeve-type carton is erected. The flap folding assembly 10 is positioned beneath carton conveyor C in the examples of each embodiments disclosed herein. Folding assembly 10 includes support assembly 11, which is comprised of vertical support arm 12 and horizontal crank link 13. Support arm 12 is fixed to crank link 13 by any suitable means such as pins or bolts. Otherwise, support arm 12 and link 13 can be formed as a unitary member. A horizontal bracket or arm 31 (FIG. 2) is attached to and extends from distal end 25 toward and beneath conveyor C. Vacuum cup 1 is attached to arm 31 adjacent end portion 32 so that vacuum cup 1 faces and opens toward conveyor C. Appropriate vacuum lines (not shown) connect vacuum cup 1 to a vacuum source.

Figure 2:
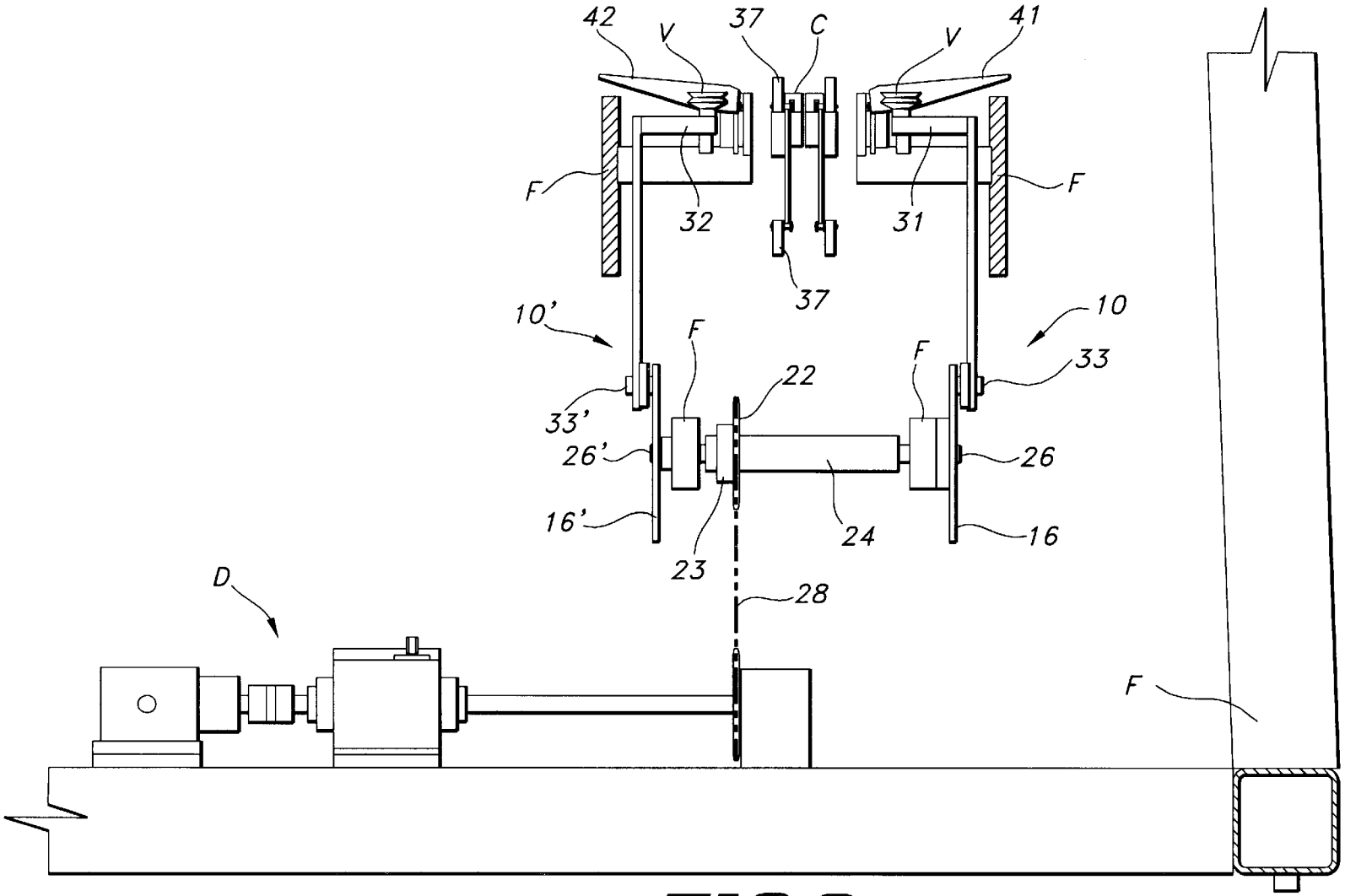
FIG. 2 a front view of the assembly of FIG. 1.

Support assembly 11 is driven in a circular path by drive assembly 15. Drive assembly 15 includes a first or driven gear 16, second gear 17 spaced from gear 16 and idler gear 18, which is positioned between gear 16 and gear 17. Idler gear 18 is positioned so that its periphery contacts the respective peripheries of gears 16 and 17. Gears 17 and 18 are journaled and supported by appropriate bearings (not shown) and shafts which extend from a portion of machine frame F, by shafts 20 and 21, respectively. The driving by an external source of gear 16 will cause gear 17 to be driven in the same direction of rotation, arrow R, through the engagement of the third or idler gear 18. A drive sprocket 22 is shown in phantom lines behind gear 16 in FIG. 1. FIG. 2 also depicts sprocket 22, which is attached to hub 23. Hub 23 is fixed to shaft 24, so that the rotation of sprocket 22 will cause shaft 24 to rotate. It is anticipated that shaft 24 can be a telescoping spline shaft, as known in the art, to enable the present invention to be utilized on packaging machines which are transversly adjustable to accommodate bottle or article groups of different sizes and configurations, and different sized cartons.

FIG. 2 shows two identical flap folding assemblies 10 and 10', spaced from one another on either side of conveyor C. Each end of shaft 24 is supported by frame F of packaging machine P and journaled by bearings (not shown) which allow shaft 24 to freely rotate along with sprocket 22. Drive gear 16 is fixed adjacent one end 26 of shaft 24. Similarly, drive gear 16' is attached adjacent the opposite end 26' of shaft 24. Alternatively, a stub shaft may be positioned to extend toward drive gear 16' from hub 23, so that the stub shaft carriers gear 16' and rotates along with the rotation of shaft 24 to cause drive gear 16' to rotate.

A drive belt or chain 28 engages and operatively connects a drive mechanism D to drive sprocket 22. The drive mechanism D can be any suitable packaging machine drive mechanism known to those skilled in the packaging machine art and, for example, can include a main drive takeoff having a gear box and speed reducer which, in turn, is driven from the main machine drive, in order to drive the flap folding assemblies 10 and 10'. Alternatively, the flap folding assemblies can be driven by a servo motor (not shown) connected either by belt or by direct drive to shaft 24, which servo motor receives control commands from the main machine computer controller (not shown). The mechanism for driving the flap folding assemblies is not critical, as long as the assemblies are driven in timed relationship with the movement of a carton along carton conveyor C. Typically, the assembly 10 will be driven so that the drive assembly 15 moves the vacuum cup 1 one revolution per carton.

Drive gear 16 supports post or stub shaft 33, so that shaft 33 extends outwardly, as shown in FIG. 2. Gear 17 similarly supports post or stub shaft 34, which also extends outwardly (FIG. 1) parallel to shaft 33. Also shown in FIG. 1, crank link 13 includes bearings 35 and 36 which are seated within link 13 and receive stub shafts 33 and 34, respectively. Therefore, as gears 16 and 17 are driven in the same direction of rotation R, support assembly 11 moves in a circular path along with gear 16 and 17, being supported by stub shaft 33 and 34 through bearings 35 and 36, so that the vacuum cup 1 also moves in a circular path through complete revolutions in a clockwise direction from the view of FIG. 1.

Conveyor C has lugs 37 (FIG. 2) extending away from chain 38 for pushing cartons in the downstream direction. The packaging machine P also includes guides 41 and 42, which comprise elongate plates and are mirror images of one another and spaced above and on each side of conveyor C. Guides 41, 42 also are welknown in the art and extend a distance of, for example, approximately three feet, along conveyor C in the downstream direction from flap folding assemblies 10 and 10', although other lengths for the guides can be utilized, depending upon the application. Guides 41 and 42 serve to hold the major, lower flaps of the carton and the carton's bottom wall which is attended to the lower flaps in a lowered position as the carton moves in the downstream direction while it is being erected. Therefore, the length of the guides will depend upon the type of carton erection used, and the time required to hold the bottom wall of the carton against conveyor C while the carton's upper wall is being raised to erect the carton.

Figure 4A:
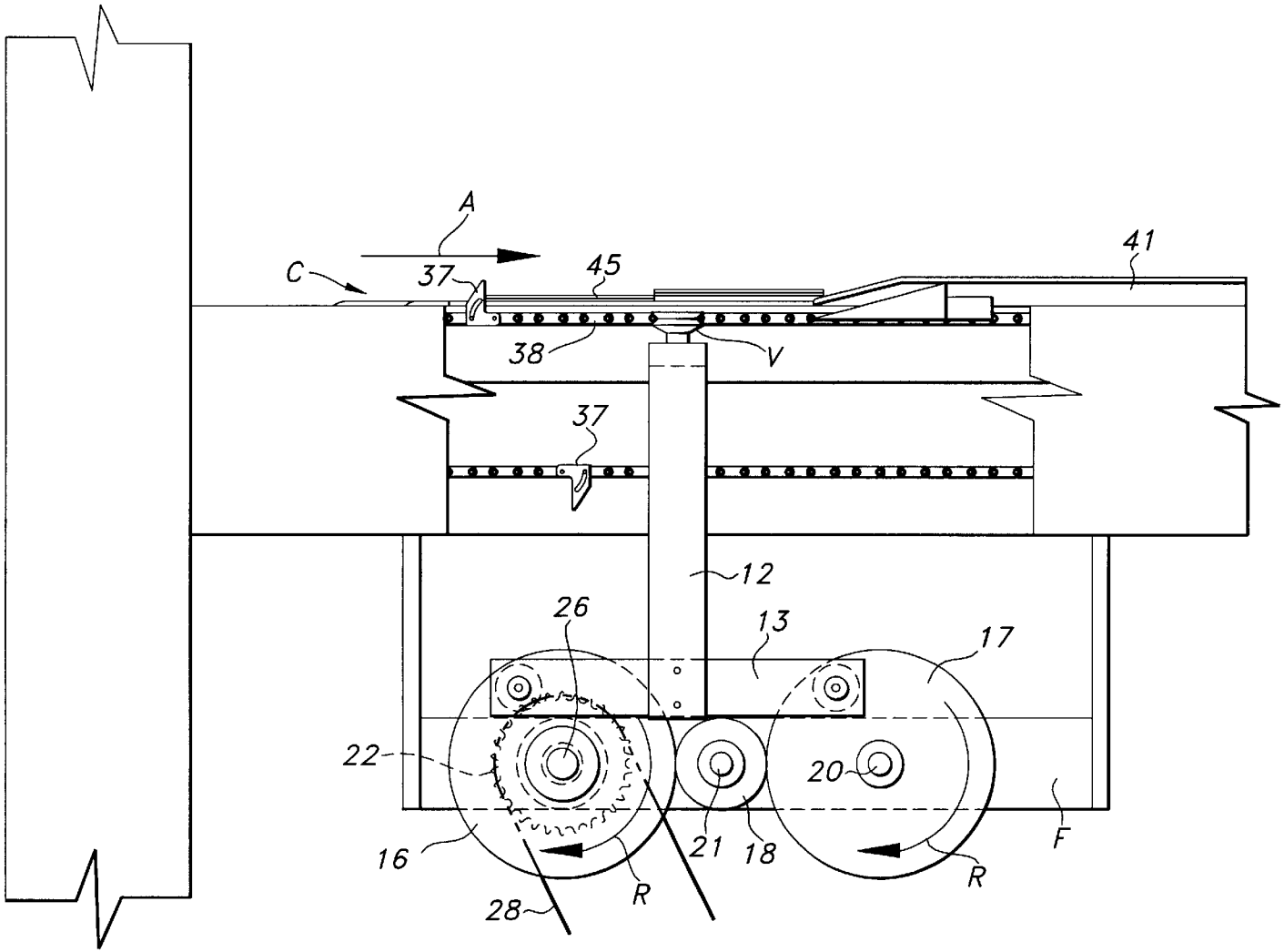
FIGS. 4A–4C are sequential side views of the flap folding assembly of the present invention folding a carton flap beneath a guide of the packaging machine.
Figure 4B:
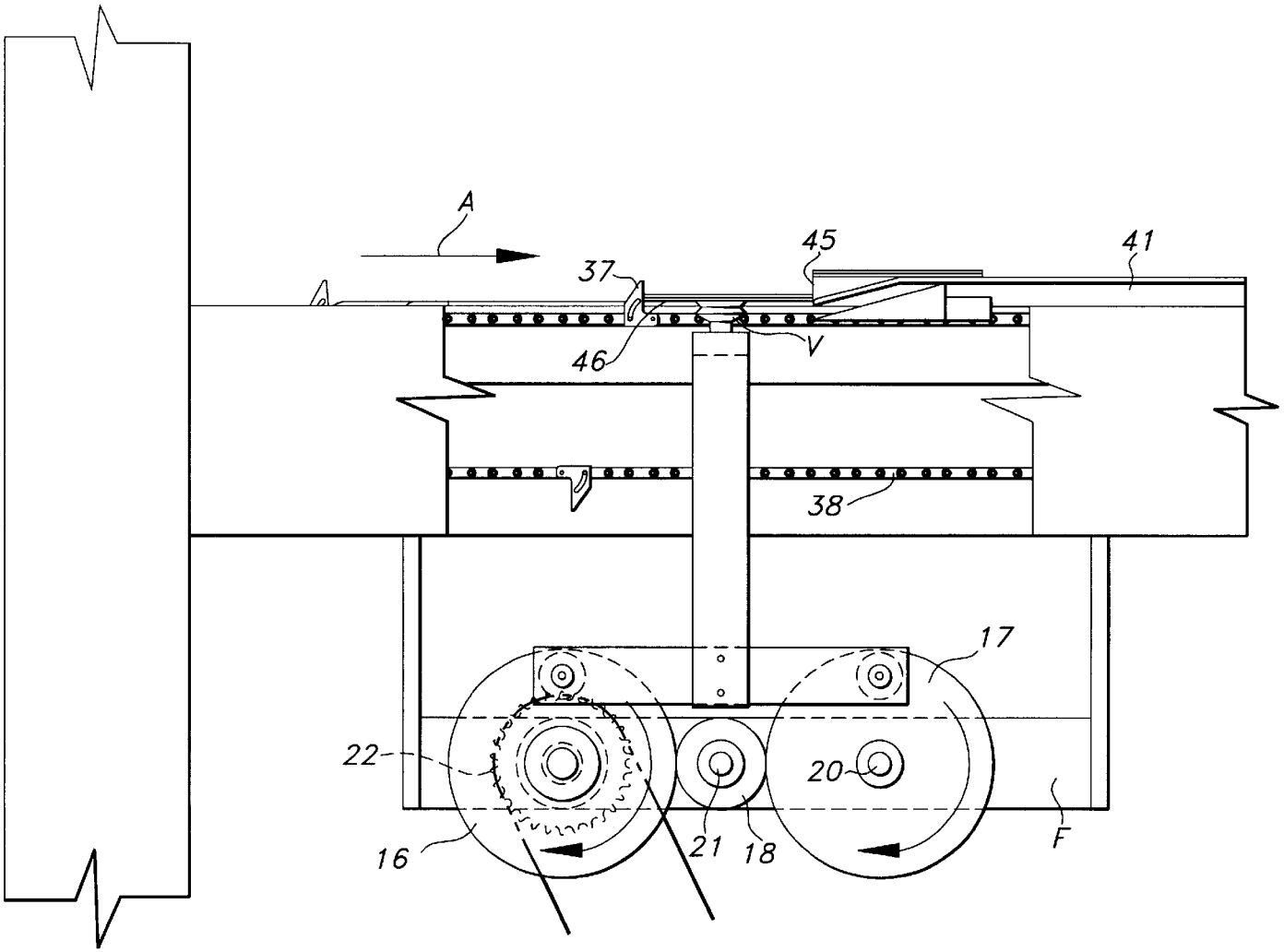
Figure 4C:
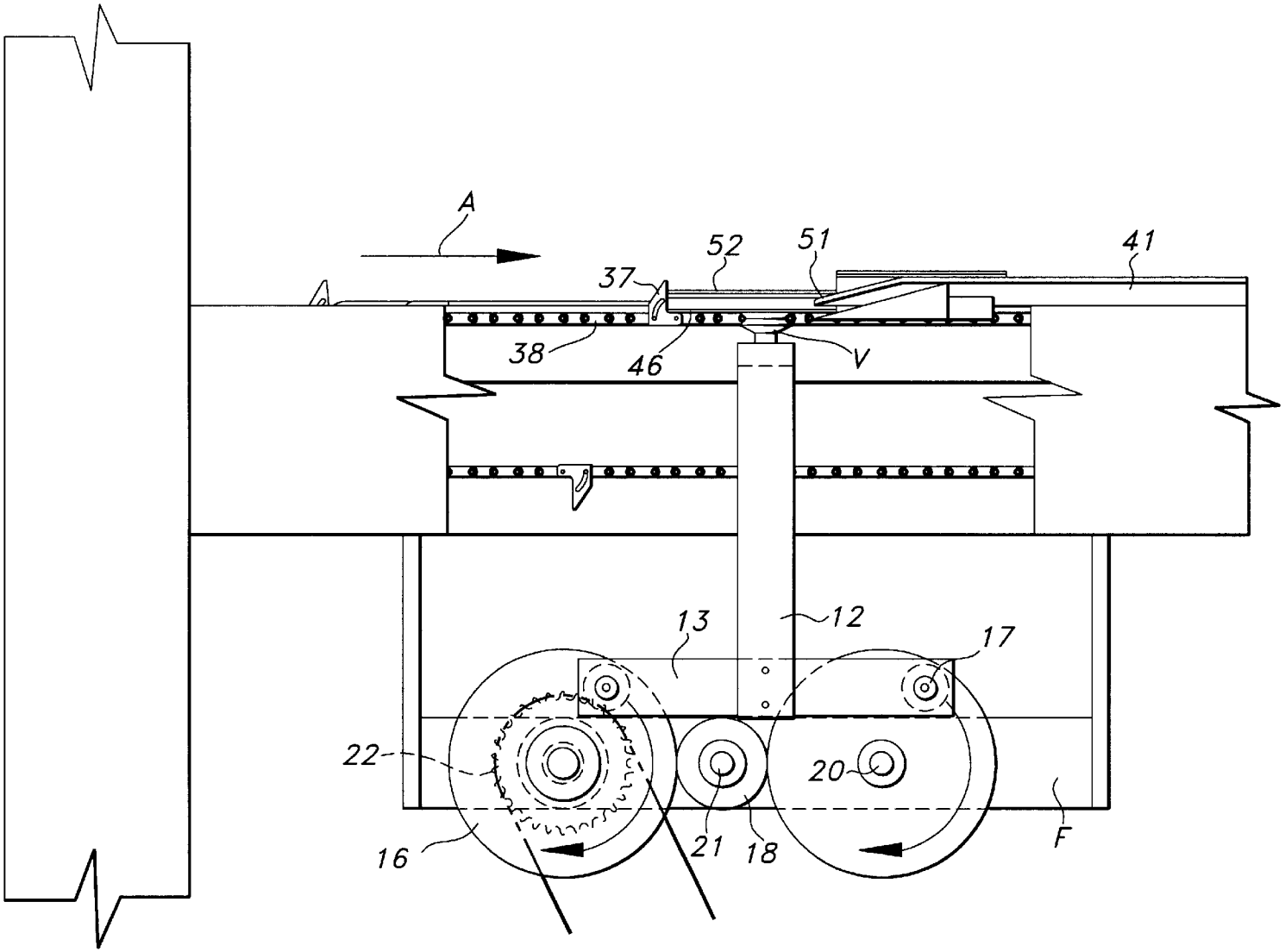

FIGS. 4A through 4C sequentially depict the flap folding process of the present invention. In FIG. 4A carton 45 is being transported in the downstream direction of arrow A by carton conveyor C. In the sequential view of FIG. 4A, the vacuum cup V of the flap folding apparatus 10 has been positioned just beneath but not contacting carton 45 as it moves downstream. FIG. 4B shows the next sequential step in the folding process,,in which carton 45 has been moved further downstream and in a position in which a lower major flap 46 of one end of carton 45 has been positioned directly over flap folding apparatus 10, and vacuum cup V has been positioned so as to contact lower major flap 46. At this position, vacuum is supplied from a vacuum source (not shown) to vacuum cup V so that vacuum cup V releasably engages flap 46. Cup V will be held by vacuum to flap 46 until the vacuum is released. The manner of controlling the vacuum from the vacuum source to the vacuum cup V is a matter of design choice. Various control assemblies well machine art can be used. For example, a mechanical valve can be arranged to turn on the vacuum as the vacuum cup V approaches flap 46, and turn off the vacuum and release flap 46 after the flap has been positioned below guide 41 as conveyor C continues to push the carton 45 downstream. If the packaging machine is controlled by a main computer, as many packaging machines are controlled, an electronic valve can be used, which receives signals from the machine controller to turn on and off the vacuum at appropriate times. It is only required to turn on the vacuum as the cup approaches the flap, so that the flap is held by the cup as the carton continues to move downstream, and to release the cup after the flap is positioned beneath the guide. Pressurized air resulting in a forced release of the flap from the vacuum cup also could be incorporated into the control valve (not shown).

Figure 3:
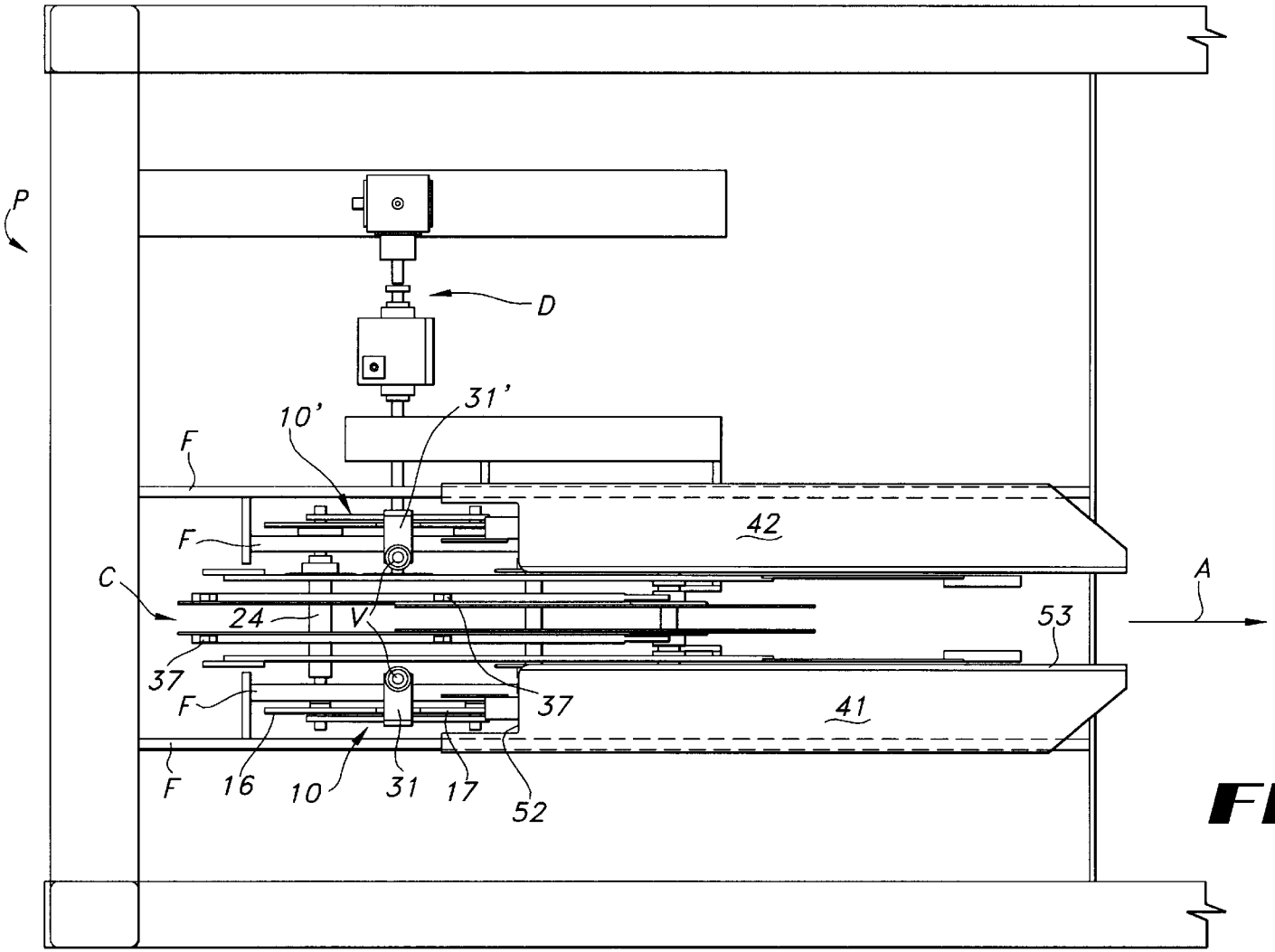
FIG. 3 is a top plan view of two flap folding assemblies of FIG. 1.

As shown in FIG. 4C, gears 16 and 17 have been rotated so as to move support assembly 11 further clockwise, and thereby move vacuum cup V further along its circular path. Vacuum cup V has been moved downwardly in an arc, which pulls, flap 46 downwardly with cup V. Flap 46 has been moved toward the lower or downwardly extending leading edge 51 of guide 41 so that flap 46 moves below edge 51 as conveyor C continues to move carton 45 in the downstream direction. As also shown in FIG. 4C, the upper major flap 52 of carton 45 moves over edge 51. Therefore the flap folding apparatus 10 has successfully folded the flap 46 downwardly just to an extent by which the flap will pass beneath the leading edge 51. Since the inner edge 53 of guide 41 (FIG. 3) is positioned along the score line or the fold line (not shown) between flap 46 and the side wall of carton 45, the carton is now held in a position along conveyor C so that the carton can be erected by known means, such as by the mechanical action of the lugs 37 or by other carton erecting mechanisms.

Figure 5:
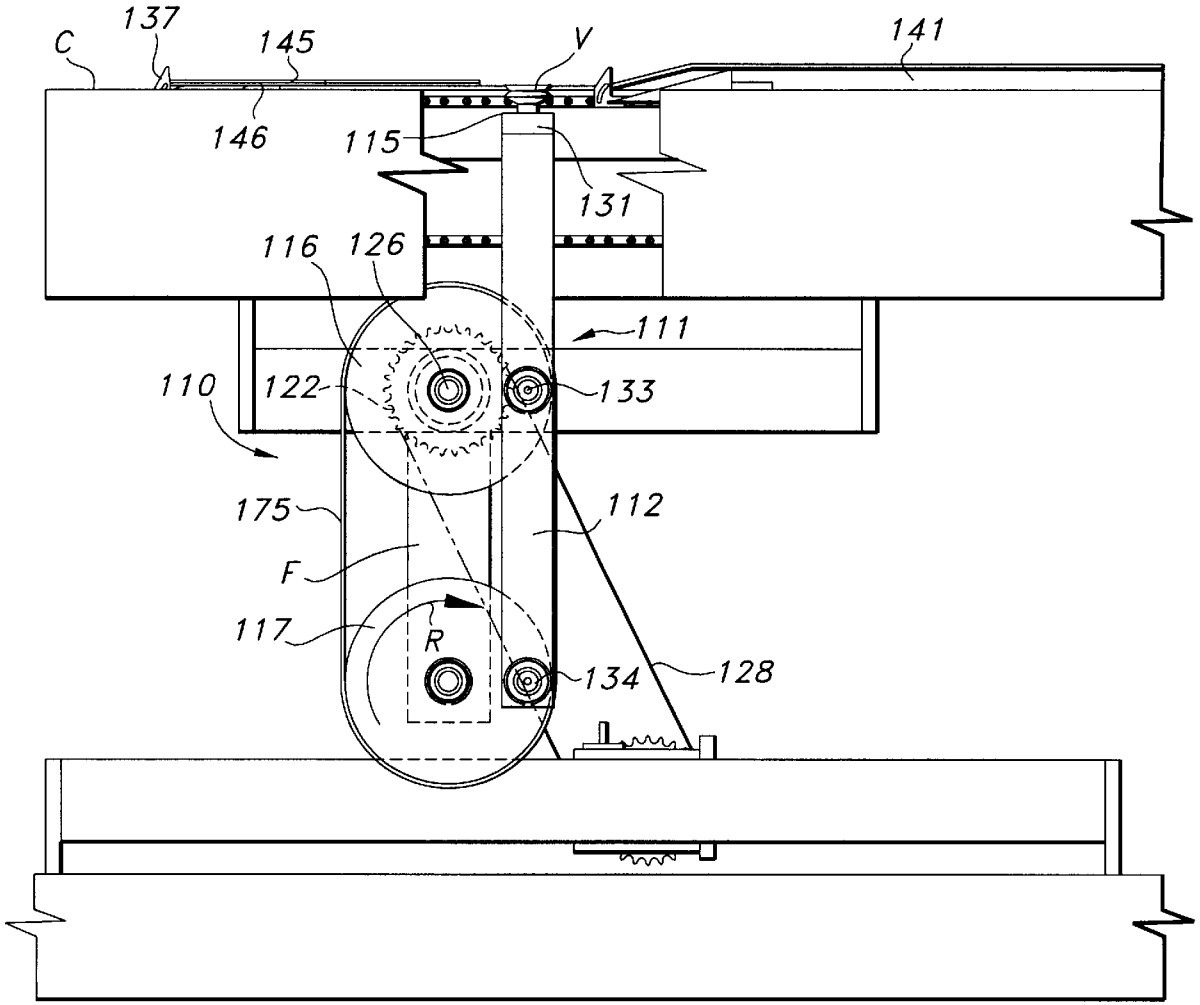
FIG. 5 schematic view of a second embodiment of the present invention.

FIG. 5 shows a second embodiment of the present invention, in which a flap folding apparatus 110 includes a first or drive gear 116, a second gear 117 and a drive sprocket 122, which function identically elements 16, 17 and 22 of the preferred embodiment. In the second embodiment of FIG. 5, gear 116 includes post or stub shaft 133, and gear 117 includes post or stub shaft 134. The embodiment of FIG. 5 differs from the preferred embodiment, however, in that gears 116 and 117 are vertically arranged instead of horizontally arranged. A vertical support assembly 111 includes support arm 112 which functions both as the support arm and as the crank link 12 and 13 of the first embodiment. A horizontal arm or bracket 131 is attached to the distal end 115 of support arm 112, and supports upstanding vacuum cup V. Assembly 111 is driven identically to assembly 11, that is by drive sprocket 122 which is driven by a suitable drive assembly, which rotates shaft 126 which is attached to sprocket 122, turning gear 116. In second embodiment, however, a belt or chain 175 wraps around the peripheries of gears 116 and 117, respectively, so that when drive gear 116 is rotated, the second gear 117 also is driven in the same direction of rotation R. Vacuum cup V of this second embodiment, therefore, also is driven in the circular path, and functions to contact lower, major flap 146 and pull lower major flap 146 downward, below guide 141, as in the first embodiment.

Figure 6:
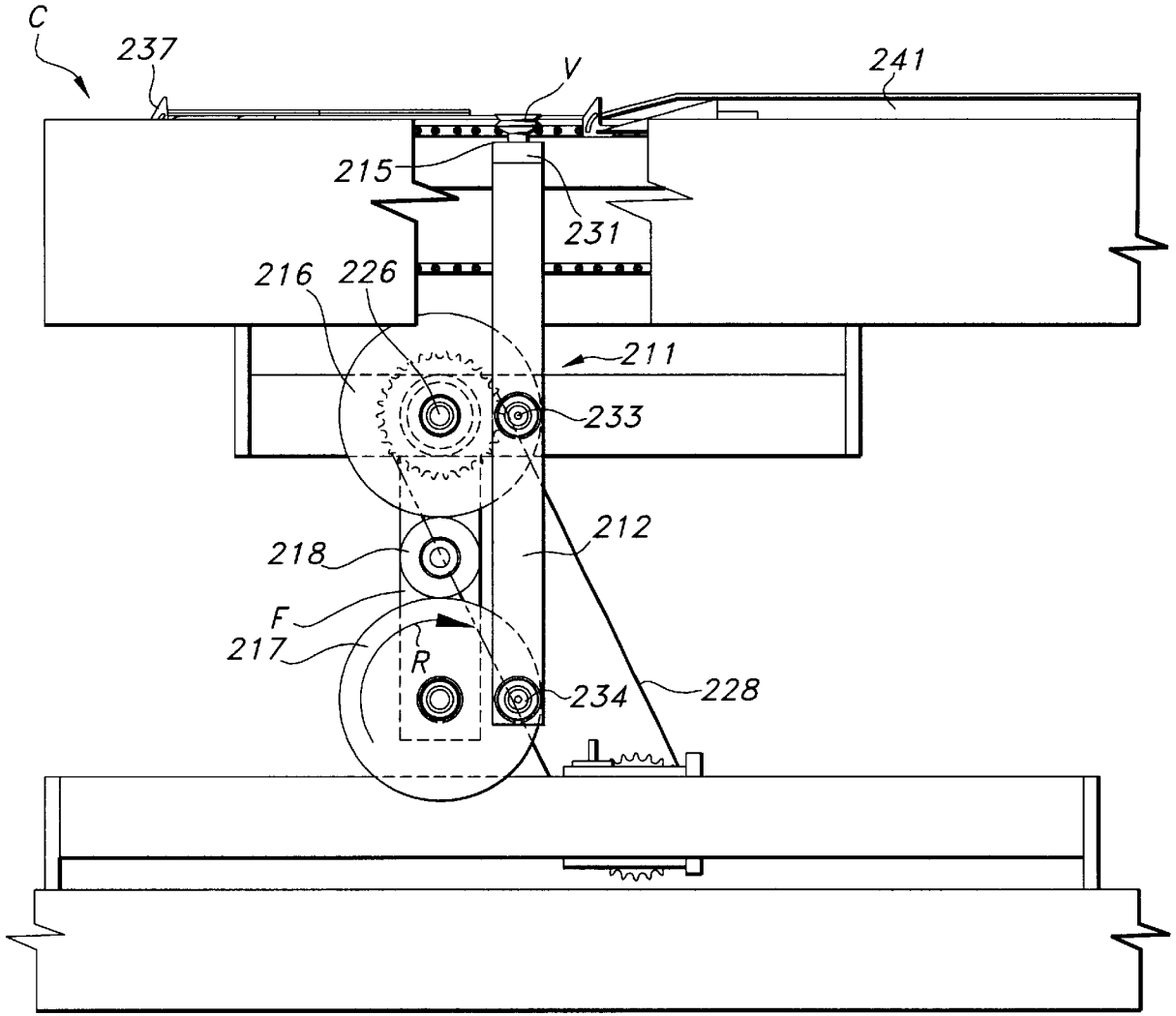
FIG. 6 is a schematic view of a third embodiment of the present invention.

A third embodiment is shown in FIG. 6, and includes the identical elements of the second embodiment shown in FIG. 5, with the exception of the drive components linking drive gear 216 to second gear 217. In the third embodiment of FIG. 6, the connecting belt or chain 175 illustrated in FIG. 5 has been eliminated, and an idler gear 218 is positioned between drive gear 216 and gear 217 in order to rotate gears 217 and gear 216. This drive arrangement is similar to that described above with respect to the first embodiment.

Figure 7:
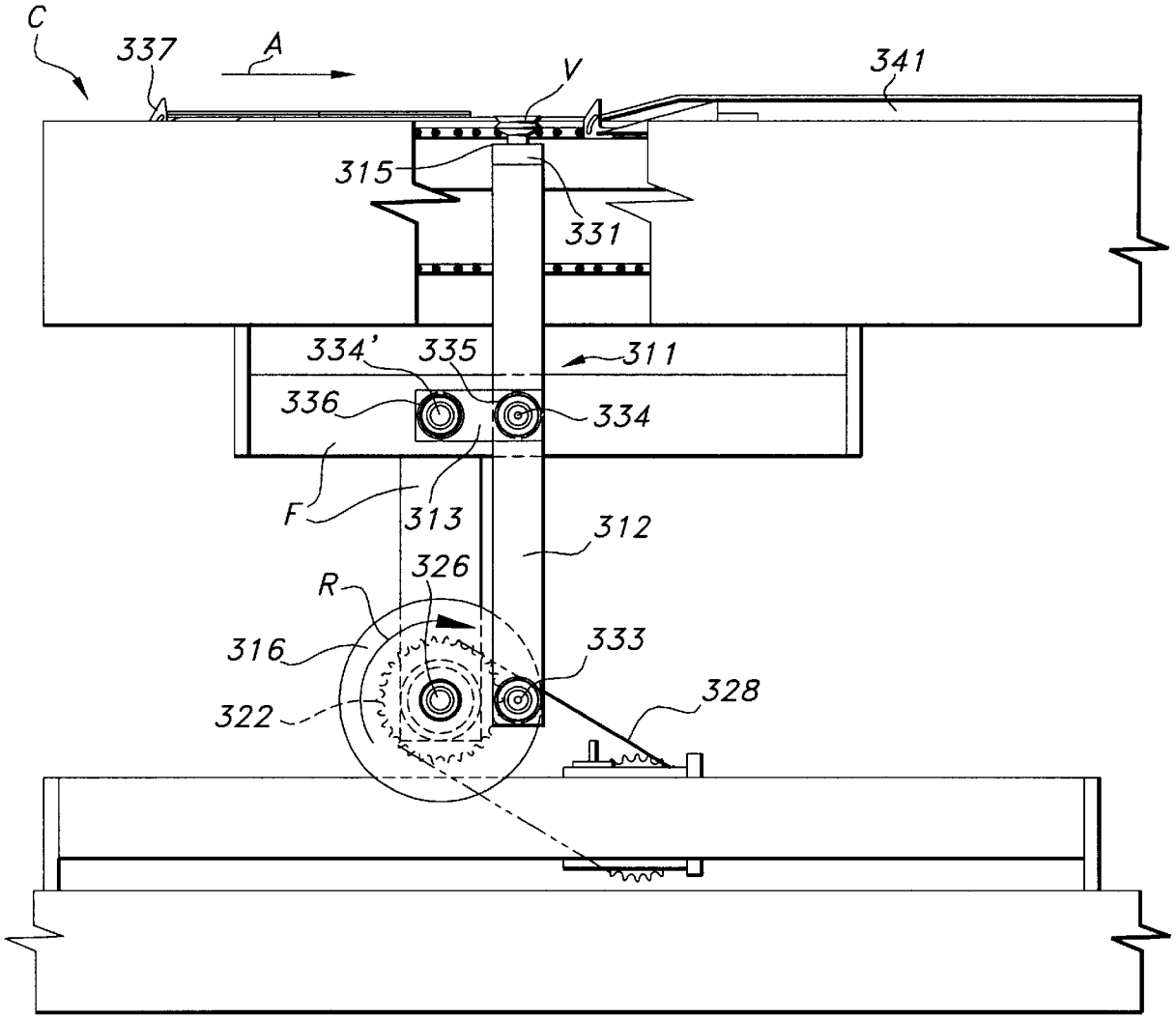
FIG. 7 is a schematic view of a fourth embodiment of the present invention.

FIG. 7 depicts a fourth embodiment of the present invention. This embodiment includes a drive gear 316 driven by a drive sprocket 322 from any suitable drive source, similar to that of the first embodiment. In the fourth embodiment shown in FIG. 7, a support arm 312 of support assembly 311 is attached at its lower end to post 333 extending outwardly from drive gear 316. Approximately at the midpoint of arm 312, a crank link 313 is positioned. Crank link 313 supports outwardly extending stub shaft or post 334, which extends through a bearing 335 held within arm 312. Another shaft or post 334' is fixed to and extends outwardly from frame F. Bearing 336 is held within the opposite end of crank link 313 around shaft 334'. As drive gear 316 is driven in a clockwise direction of rotation R as viewed in FIG. 7, support arm 312 is caused move so that vacuum cup V moves in the circular path is in the previous embodiments discussed above.

The drive mechanisms and vacuum control mechanisms for the second, third and fourth embodiments are identical as discussed with respect to the first embodiment, and well known in the packaging machine art.

While preferred embodiments have been illustrated and described above, it is recognized that variations may be made with respect to features and components of the invention. Therefore, while the invention has been disclosed in preferred forms only, it will be obvious to those skilled in the art that many additions, deletions and modifications can be made therein without departing from the spirit and scope of this invention, and that no undue limits should be imposed thereon except as set forth in the following claims.

What is claimed:

1. In a packaging machine for folding cartons moving along a carton conveyor, wherein the cartons include major upper and lower flaps, and with the packaging machine having at least one guide with a leading edge, a flap folding apparatus comprising:

a drive mechanism for driving said folding apparatus;

a pair of flap folding assemblies, each flap folding assembly comprising a first drive wheel and a second drive wheel spaced from said first drive wheel and connected to said drive mechanism, and each flap folding assembly comprising a vacuum engagement assembly carried by said first drive wheel, said vacuum engagement assembly having a vacuum cup and a support assembly supporting said vacuum cup, wherein selective actuation of said drive assembly causes said first and second drive wheels to rotate simultaneously in the same direction of rotation and simultaneously causes said support assembly to move so that the vacuum cup moves toward said carton conveyor, wherein said vacuum engagement assembly engages the major lower flap while moving downstream with the carton conveyor, wherein said vacuum cup releases the major lower flap when the major lower flap is under said leading edge, and wherein said vacuum assembly then moves upstream with respect to the conveyor to engage another carton on the conveyor; and a telescopic spline shaft connecting each first drive wheel to said drive mechanism, wherein the length of said telescopic spline shaft is adjustable to accommodate cartons of varying dimensions.

2. The packaging machine of claim 1, wherein said vacuum cup moves in a circular path as said support assembly moves.

3. The packaging machine of claim 1, wherein each flap folding assembly further comprises an idler wheel contacting said first drive wheel and said second drive wheel, said idler wheel turning in the opposite direction of rotation as said first and second drive wheels as said first and second drive wheels are rotated.

4. The packaging machine of claim 1, wherein each flap folding assembly further comprises a first pin carried by said first drive wheel and a second pin carried by said second drive wheel.

5. The packaging machine of claim 4, wherein said support assembly defines pin receiving openings and first pin and said second pin are received in said pin receiving openings.

6. The packaging machine of claim 4, wherein said support assembly carries a first bearing and a second bearing spaced from said first bearing, and wherein said first pin is journaled by said first bearing and said second pin is journaled by said second bearing.

7. The packaging machine of claim 1, wherein said support assembly includes a first bar portion and a second bar portion extending from said first drive wheel to said second drive wheel, and a second bar portion having a proximate end portion adjacent to said first bar portion and wherein said second bar portion includes a distal end extending away from said first bar portion.

8. The packaging machine of claim 7, wherein said vacuum cup is supported by said support cup at said distal end.

9. The packaging machine of claim 1, wherein said support assembly comprises a link coupled to said vacuum cup for maintaining said vacuum cup in a substantially perpendicular orientation with respect to the major lower flap.

10. A method for folding carton flaps in a packaging machine having at least one guide with a leading edge, said method comprising the steps of:

loading a carton onto a conveyor;

moving the carton in a downstream direction with said conveyor;

actuating a drive mechanism to drive a pair of flap folding assemblies, each flap folding assembly comprising a first drive wheel and a second drive wheel spaced from said first drive wheel and connected to said drive mechanism, each flap folding assembly comprising a vacuum engagement assembly carried by said first drive wheel, said vacuum engagement assembly having a vacuum cup and a support assembly supporting said vacuum cup;

rotating a telescopic spline shaft connected to each first drive wheel, thereby simultaneously rotating said first and second drive wheels in the same direction of rotation, thereby causing said support assembly to move so that said vacuum cup moves toward said carton conveyor;

engaging a carton flap with said vacuum cup while moving said vacuum engagement assembly downstream with the carton conveyor;

releasing the major lower flap from said vacuum cup when the major lower flap is under said leading edge; and moving said vacuum engagement assembly upstream with respect to the conveyor to engage another carton on the conveyor.

* * * * *